United States Patent [19]

Broders

[11] Patent Number: 4,502,232

[45] Date of Patent: Mar. 5, 1985

[54] CARPET LAYER'S WAVE-FORM TEMPLATE

[76] Inventor: Jack R. Broders, P.O. Box 991, Scappoose, Oreg. 97056

[21] Appl. No.: 532,709

[22] Filed: Sep. 16, 1983

[51] Int. Cl.[3] ..... B43L 7/00

[52] U.S. Cl. ..... 33/174 G; 33/177; 33/479

[58] Field of Search ..... 33/174 B, 174 G, 479, 33/174 S, 177, 1 B

[56] References Cited

U.S. PATENT DOCUMENTS

| | | | |
|---|---|---|---|
| 2,507,073 | 5/1950 | White | 33/1 B |
| 2,795,854 | 6/1957 | Perkal | 33/174 G |
| 3,107,434 | 10/1963 | Niel | 33/177 |
| 3,203,100 | 8/1965 | Hegedus | 33/174 G |
| 3,220,115 | 11/1965 | Puckett . | |
| 3,509,633 | 5/1970 | Fernandes | 33/174 G |
| 3,548,505 | 12/1970 | Candilo | 33/174 G |
| 3,911,584 | 10/1975 | Ajus | 33/174 B |

*Primary Examiner*—Robert I. Smith
*Attorney, Agent, or Firm*—Eugene D. Farley

[57] ABSTRACT

A wave-form carpet layer's template used for cutting the edges of pieces of carpeting in matching wave-form patterns preliminary to sewing the side edges together in a substantially invisible seam. The template comprises a flat, rigid strip of structural material having two legs arranged substantially at right angles to each other. The inner and outer side edges of both legs have uniform wave-form contour, the crests of the inner side edges being opposite the valleys of the outer side edges. The width of each leg is substantially equal to one-half the wave length of the wave-form contour. The apex of the two meeting outside edges is located in the crest portion of one of the side edges and the valley portion of the other of the side edges.

2 Claims, 7 Drawing Figures

FIG. 3
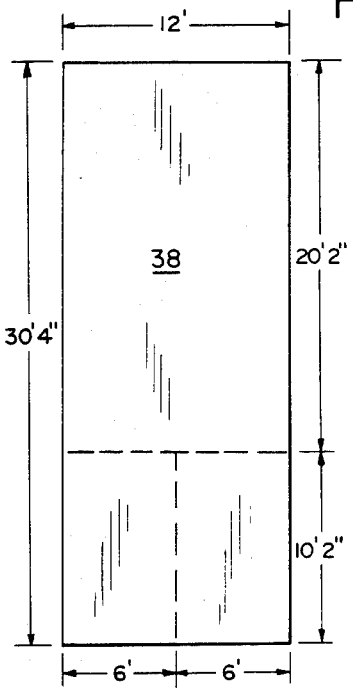
FIG. 4
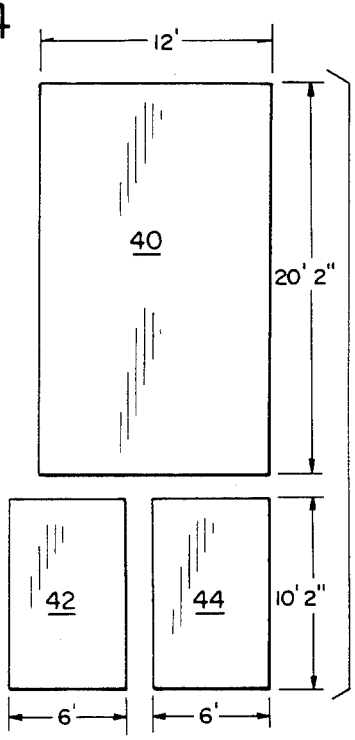
FIG. 5
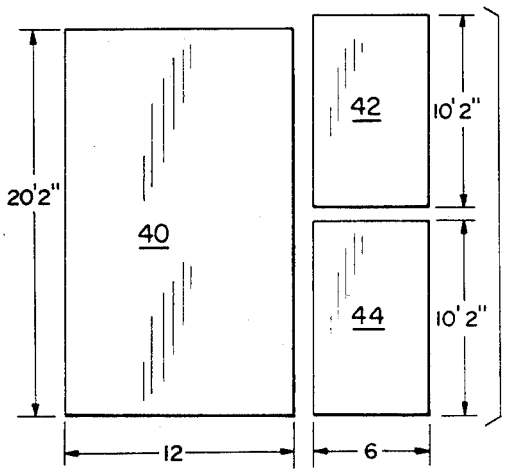
FIG. 6
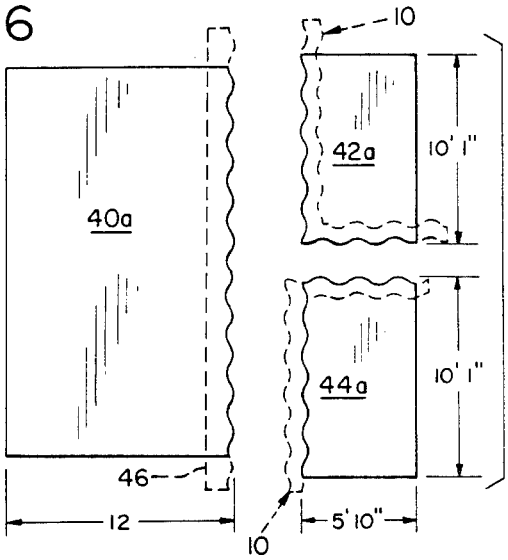
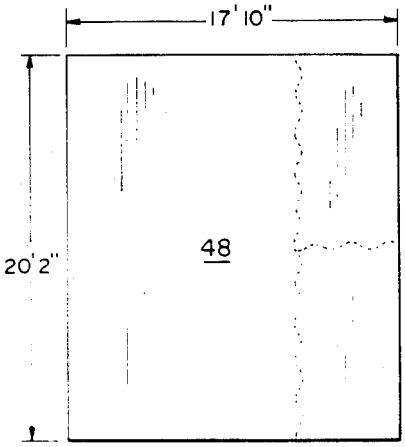
FIG. 7

CARPET LAYER'S WAVE-FORM TEMPLATE

BACKGROUND AND GENERAL STATEMENT OF THE INVENTION

This invention relates to templates used by carpet layers for cutting the edges of pieces of carpet in matching wave-form patterns preliminary to sewing the pieces together to form a substantially invisible seam.

In laying carpeting, particularly wall-to-wall carpeting, it frequently is necessary to piece carpet segments together. If the pieces are defined by straight line cuts, the resulting sewn seam is quite evident. It is substantially invisible to the casual observer if the pieces are cut with matching, wavy side edges and then sewn together.

A straight, flat template having a wavy contour is known, and used for cutting a straight wavy line in carpeting. It is laid on the carpet and the carpet cut on the wavy contour of the template. However, were large pieces to be composited from several small pieces, the straight tool cannot be applied effectively because it is difficult to make the wavy cuts match together.

It is the general purpose of the present invention to provide a carpet layer's wave-form template the use of which enables the carpet layer to cut the edges of pieces of carpeting in wave-form patterns which match exactly even when the pieces are of non-uniform size and multiple in number.

It is a further object of the present invention to provide a carpet layer's wave-form template which is simple in construction, and easy and accurate to use.

It is a further object of the present invention to provide a carpet layer's wave-form template which makes possible the use of scrap pieces of carpeting which otherwise might be wasted, and which insures against the cutting of mis-matched carpet edges. Its use accordingly results in the saving of substantial quantities of costly carpeting over a period of time.

Broadly considered, the carpet layer's wave-form template which achieves the foregoing and other purposes of the invention comprises a strip of flat, rigid steel or other structural material, having two legs arranged substantially at right angles to each other. The inner and outer side edges of both legs of the template have a uniform, wave-form contour.

The template successfully achieves its purpose by reason of the fact that the location of the crests and valleys of the wave-form contour are positioned in a predetermined critical manner with respect to the arrangement of the two legs of the template.

Thus the width of each leg is predetermined at a value equal to about one-half the wave length of the wave-form contour of the leg side edges. Also, the apex of the meeting outside side edges is located in the crest portion of a component wave of the wave-form contour of one of the meeting outside edges and in the valley portion of the wave-form contour of the other of the meeting outside edges. When this relationship is present, the versatility of the tool is greatly increased in that it may be applied to the cutting of exactly matching wave-form patterns in the edges of pieces of carpeting to be sewn together.

THE DRAWINGS

FIGS. 3–7 inclusive are schematic plan views further illustrating the application of the template to the piecing together of a number of pieces of carpet into a composite whole.

Figure 1:
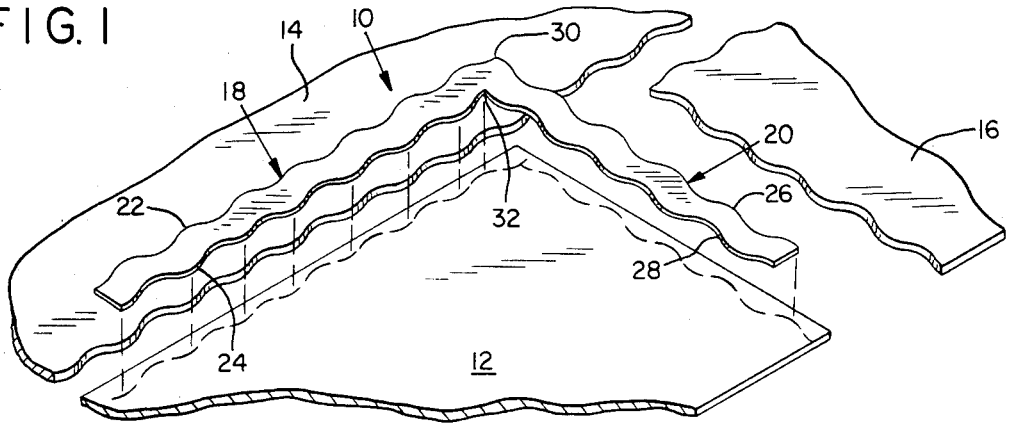
FIG. 1 is a fragmentary, top perspective view illustrating the carpet layer's wave-form template of the present invention in its application to the cutting of pieces of carpeting.
Figure 1:
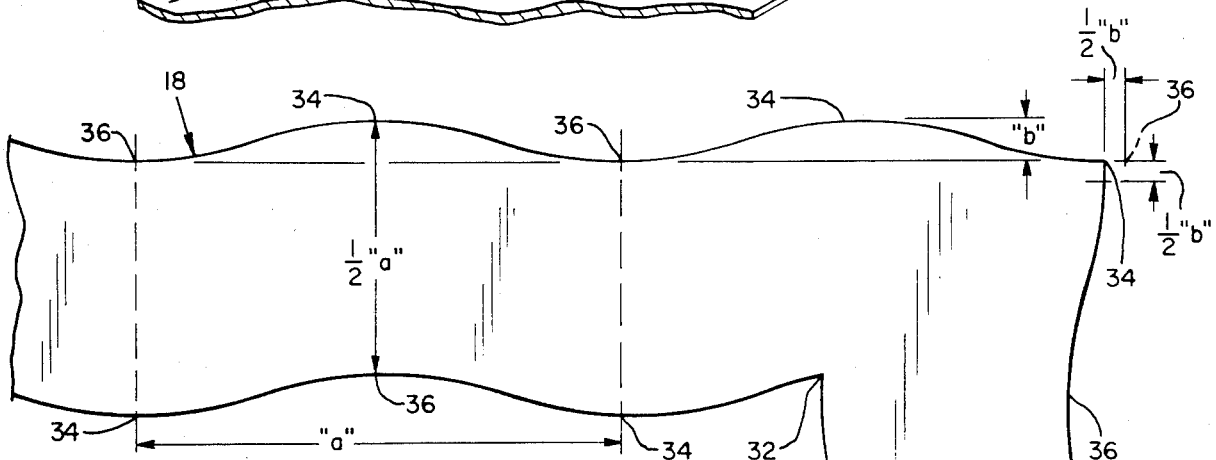

As shown in FIG. 1, the template of my invention, illustrated generally at 10, is applied to cutting a wave-form pattern in the edges of carpet piece 12 to match the wave-form edges of carpet pieces 14, 16 to which the edges of piece 12 are to be sewn.

Template 10 is fabricated from a strip of flat, rigid structural material such as plastic, wood, or metal, preferably steel. It has two legs arranged substantially at right angles to each other. These are indicated generally at 18, 20 respectively. Leg 18 has outside side edge 22 and inside side edge 24. Leg 20 has outside edge 26 and inside edge 28. The apex or meeting point of outside edges 22, 26 is indicated at 30; that of inside edges 24, 28, at 32. The crests of the wave-form contour of both legs are indicated at 34, and the valleys thereof at 36.

The crests 34 of the wave-form contour of the inner side edges of both legs are opposite the valleys 36 of the wave-form contour of the outer side edges of both legs.

Figure 2:
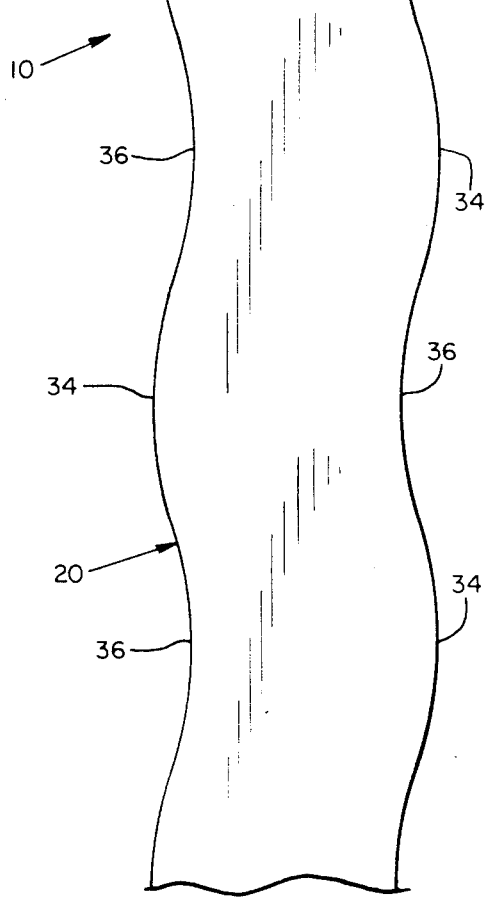
FIG. 2 is an enlarged, fragmentary plan view of the template.

Legs 18, 20 are of uniform width. However, as shown in FIG. 2, the width of each leg (one-half "a") is equal to one-half the wave length ("a") of the wave form contour of the leg side edges.

It is further desirable for the successful application of the hereindescribed template that the apex 30 of the meeting outside edges 22, 26 be located in the crest portion of a component wave of the wave-form contour of one of the meeting outside edges and in the valley portion of the wave-form contour of the other of the meeting outside edges.

More specifically, the apex of the meeting outside edges should be centrally located with respect to the wave crest and valley portions. It preferably should be offset from the wave crest and valley maxima by an increment substantially equal to one-half the amplitude of the wave-form contour of the template side edges.

Again referring to FIG. 2: where the amplitude of the waveform contour of the template side edges has a value of "b", apex 30 of the outside side edges should be offset from the maxima of the crest portion 34 and a valley portion 36 of the wave form contours by an increment of one-half "b".

OPERATION

The manner of application of the hereindescribed template is illustrated with particular reference to FIGS. 3–7 inclusive.

The problem illustrated is that of carpeting a room space which measures twenty feet two inches in one dimension and seventeen feet ten inches in another dimension with carpeting which is twelve feet wide on the roll. In the practice of the present invention the carpet layer will order out a strip of carpet which measures twelve feet by thirty feet four inches, i.e. carpet pieces 38 of FIG. 3.

He next will cut along the dashed lines of FIG. 3. This will provide a base piece 40 measuring twelve feet by twenty feet two inches, thereby giving him the desired dimension of twenty feet two inches in base piece 40. It also will provide smaller pieces 42, 44, each of which measures six feet by ten feet two inches. These two pieces are to be used to build up base piece 40 to the desired width.

This possibility is indicated by the arrangement of the pieces in the manner illustrated in FIG. 5.

The next sequence of operations has for its purpose cutting the meeting edges of the three pieces in wave-form patterns which will exactly mesh so that the pieces can be sewn together with invisible seams. The manner in which this is accomplished is illustrated in FIG. 6.

First, the meeting side edge of piece 40 is cut in a waveform pattern using an elongated straight template 46.

Next the meeting side edges of piece 42 are cut in waveform patterns using the hereindescribed right angle template 10. Both cuts are made along the outside side edges of the template.

The template then is flopped over, i.e. rotated 180°, and used to cut wave-form contours into the side edges of piece 44. In this instance the outside side edge of the template is used to cut the edge facing piece 42 and the inside side edge of the template to cut the edge opposite piece 40.

The result will be three new pieces indicated at 40*a*, 42*a* and 44*a* of FIG. 6. The side edges of each of these pieces which are opposite the side edges of the companion pieces will be cut in exactly matching wave-form patterns. Furthermore, the small amount of trim will reduce the overall dimensions of the resulting composite to the exact dimension desired in the finished piece.

The three pieces then may be interfitted and sewn together to form the finished piece, i.e. piece 48 of FIG. 7, of exactly the right dimensions, with invisible seams. This piece may then be stretched and nailed in place in the area to be carpeted.

Having thus described my invention in preferred embodiments, I claim:

1. A carpet layer's wave-form template comprising a strip of flat, rigid structural material having two legs arranged substantially at right angles to each other, the inner and outer side edges of both legs of the strip having a uniform, wave-form contour, the crests of the wave-form contour of the inner side edges being opposite the valleys of the wave-form contour of the outer side edges, the width of each leg being substantially equal to one-half the wave length of the wave-form contour of the side edges of the two legs, and the apex of the meeting outside side edges being located in the crest portion of a component wave of the wave-form contour of one of the meeting outside side edges and in the valley portion of the wave-form contour of the other of the meeting outside side edges.

2.

The template of claim 1 wherein the apex of the meeting outside side edges is offset from the wave crest and valley maxima by an increment substantially equal to one-half of the amplitude of the wave-form contour of the template side edges.

* * * * *